US009772108B2

(12) United States Patent
Rangwala et al.

(10) Patent No.: US 9,772,108 B2
(45) Date of Patent: Sep. 26, 2017

(54) METHODS AND SYSTEMS FOR CLEAN-UP OF HAZARDOUS SPILLS

(71) Applicant: Worcester Polytechnic Institute, Worcester, MA (US)

(72) Inventors: Ali S. Rangwala, New London, CT (US); Xiaochuan Shi, Worcester, MA (US); Kemal S. Arsava, Dracut, MA (US); Glenn Mahnken, Newton, MA (US)

(73) Assignee: Worcester Polytechnic Institute, Worcester, MA (US)

( * ) Notice: Subject to any disclaimer, the term of this patent is extended or adjusted under 35 U.S.C. 154(b) by 100 days.

(21) Appl. No.: 14/925,883

(22) Filed: Oct. 28, 2015

(65) Prior Publication Data

US 2016/0123582 A1 May 5, 2016

Related U.S. Application Data

(60) Provisional application No. 62/073,259, filed on Oct. 31, 2014, provisional application No. 62/164,199, filed on May 20, 2015.

(51) Int. Cl.

| | |
|---|---|
| ***F23K 5/12*** | (2006.01) |
| ***F23G 7/05*** | (2006.01) |
| ***F23D 5/12*** | (2006.01) |

(52) U.S. Cl.

CPC ..... *F23G 7/05* (2013.01); *F23D 5/123* (2013.01); *F23G 2900/50213* (2013.01); *F23K 5/12* (2013.01)

(58) Field of Classification Search

CPC ..... F23G 7/05; F23K 5/12; F23D 5/123

(Continued)

(56) References Cited

U.S. PATENT DOCUMENTS 125,096 A * 3/1872 Levl Stevens ..... A01K 75/02 431/106

3,663,149 A 5/1972 Heagler (Continued)

OTHER PUBLICATIONS

PCT International Search Report and Written Opinion issued in International Application No. PCT/IS2015/058330 mailed Jan. 22, 2016.

(Continued)

*Primary Examiner* — Gregory Huson
*Assistant Examiner* — Nikhil Mashruwala
(74) *Attorney, Agent, or Firm* — Greenberg Traurig, LLP; Roman Fayerberg

(57) ABSTRACT

Methods and systems for clean-up of hazardous spills are provided. In some aspects, there is provided a system for burning an water-oil emulsion that includes an enclosure configured to hold a water-oil emulsion; one or more conductive rods disposed throughout the enclosure, each rod of the one or more roads having a heater portion to be submerged in the water-oil emulsion and a collector portion to project above the water-oil emulsion, wherein the collector portion is longer than the heater portion; and a delivery system for supplying an water-oil emulsion to the enclosure, the delivery system is configured to maintain a constant level of the water-oil emulsion in the enclosure as the water-oil emulsion is burned. The enclosure may further include one or more adjustable air inlets.

20 Claims, 17 Drawing Sheets

(58) Field of Classification Search
USPC ..... 431/2, 8, 202; 110/238
See application file for complete search history.

(56) References Cited

U.S. PATENT DOCUMENTS

| | | | | |
|---|---|---|---|---|
| 3,695,810 | A | 10/1972 | Heagler | |
| 4,669,972 | A | 6/1987 | Koblanski | |
| 5,328,353 | A * | 7/1994 | Keenan | E02B 15/042 210/774 |
| 8,366,439 | B2 * | 2/2013 | Ashline | E02B 15/042 431/14 |
| 2012/0040296 | A1 | 2/2012 | Ashline et al. | |
| 2013/0263766 | A1 | 10/2013 | Goruney et al. | |
| 2014/0182296 | A1 | 7/2014 | Zimmels et al. | |
| 2017/0073918 | A1 * | 3/2017 | Arsava | E02B 15/042 |

OTHER PUBLICATIONS

Rangwala, et al., "A Novel Experimental Approach to Enhance Burning of Oil-Water Emulsions by Immersed Objects," Final Report, Worcester Polytechnic Institute, Sep. 14, 2015.
Rangwala, et al., "Burning Behavior of Oil in Ice Cavaties," Final Report, Worcester Polytechnic Institute, Dec. 30, 2013.
Shi, et al., "Hydrocarbon Poll Fire Behavior around Vertical Cylinders," 8th U.S. National Combustion Meeting, May 19, 2013.
Shi, et al., "Influence of Immersed Objects on Liquid Pool Boilover," 2013 AIChE Annual Meeting, Nov. 3, 2013.

* cited by examiner

FIG. 2A
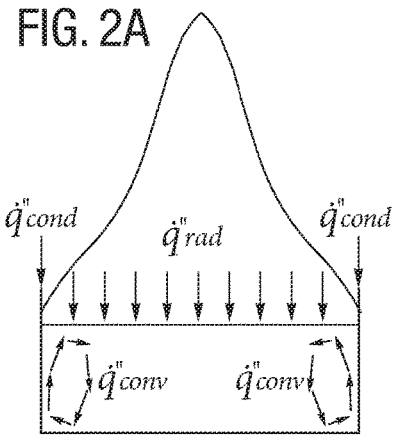
no object
FIG. 2B
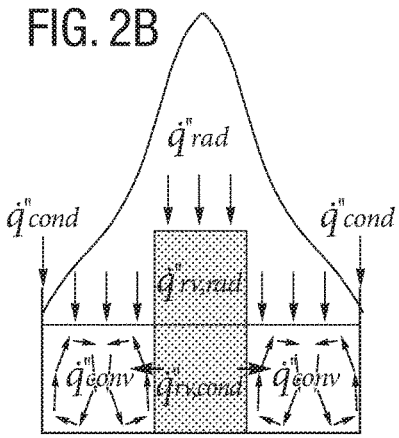
immersed object (metal rod)
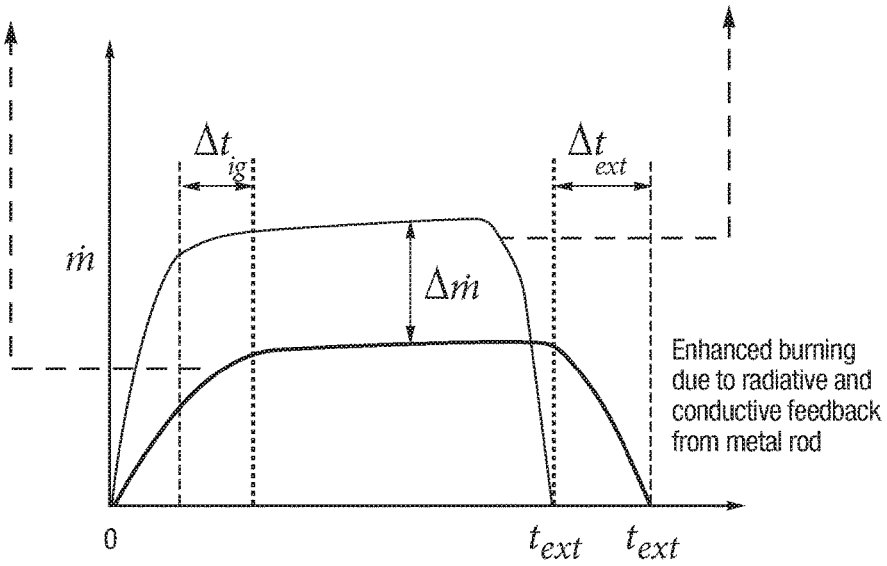
FIG. 2C — 25% — 40% - - - 60% - - - 60% Salt Water Baseline 37 Rods 59 Rods

METHODS AND SYSTEMS FOR CLEAN-UP OF HAZARDOUS SPILLS

RELATED APPLICATIONS

This application claims the benefit of and priority to U.S. Provisional Application Ser. No. 62/073,259, filed on Oct. 31, 2014, and U.S. Provisional Application Ser. No. 62/164,199, filed on May 20, 2015, both of which are incorporated herein by reference in their entireties.

STATEMENT OF GOVERNMENT SUPPORT

This invention was made with Government Support under Grant Number E14PC00043 awarded by the U.S. Department of the Bureau of Safety and Environmental Enforcement (BSEE). The Government has certain rights in the invention.

FIELD

The disclosure relates generally to methods, systems and devices for clean-up of water-oil emulsions.

BACKGROUND

Oil spill may have a devastating impact on the surrounding environment. Spilt oil penetrates into the structure of the plumage of birds and the fur of mammals, reducing its insulating ability, and making them more vulnerable to temperature fluctuations and much less buoyant in the water. Clean up and recovery from an oil spill is difficult and may take weeks, months or even years. Therefore, there is a need for improved methods and systems to clean-up oil spills.

SUMMARY

Methods and systems for clean-up of hazardous spills are provided. In some aspects, there is provided a system for burning an water-oil emulsion that includes an enclosure configured to hold a water-oil emulsion; one or more conductive rods disposed throughout the enclosure, each rod of the one or more roads having a heater portion to be submerged in the water-oil emulsion and a heat collector (or simply, collector) portion to project above the water-oil emulsion, wherein the collector portion is longer than the heater portion; and a delivery system for supplying an water-oil emulsion to the enclosure, the delivery system is configured to maintain a constant level of the water-oil emulsion in the enclosure as the water-oil emulsion is burned.

In some embodiments, the one or more rods have an adjustable height. In some embodiments, a ratio of a length of the collector portion to a length of the heater portion is between 2 and 6. In some embodiments, a height of the rod is between 25% to 75% of a baseline flame height. In some embodiments, the one or more rods are distributed among a plurality of zones, with rods in a same zone having same height and rods in different zones having different height. In some embodiments, the height of the rods increases toward a center of the enclosure. In some embodiments, the zones are concentric to one another. In some embodiments, the enclosure further includes one or more inlets. In some embodiments, the one or more inlets include a cover mechanism to adjustably change the shape of the inlet.

In some aspects, there is provided a system for burning a flammable liquid that includes an enclosure configured to hold a flammable liquid; a plurality of inlets in a wall of the enclosure; one or more rods disposed throughout the enclosure; and a delivery system for supplying the flammable liquid to the enclosure.

In some aspects, there is provided a method for burning an water-oil emulsion that includes supplying an water-oil emulsion to a holding enclosure to a pre-selected level, the enclosure having one or more heat conductive rods disposed therein, each rod of the one or more roads having a heater portion to be submerged in the water-oil emulsion and a collector portion to project above the water-oil emulsion, wherein the collector portion is longer than the heater portion; and igniting and burning the water-oil emulsion from the enclosure while maintaining the pre-selected level of the water-oil emulsion in the enclosure. In some embodiments, a water content of the water-oil emulsion is between about 20% and about 60%. In some embodiments, the one or more rods may be preheated before igniting the water-oil emulsion.

In some aspects, there is provided a method for burning a flammable liquid that includes supplying a flammable liquid to a holding enclosure to a pre-selected level, the enclosure having a plurality of adjustable air inlets disposed throughout the enclosure above the pre-selected level and one or more conductive rods disposed throughout the enclosure; burning the a flammable liquid; and adjusting air inlets positioned of the holding enclosure to maintain the burning.

BRIEF DESCRIPTION OF THE DRAWINGS

The present disclosure is further described in the detailed description which follows, in reference to the noted plurality of drawings by way of non-limiting examples of exemplary embodiments, in which like reference numerals represent similar parts throughout the several views of the drawings, and wherein:

FIGS. 2A-2C illustrate the effect of a rod (also referred to herein as an FR) in a flammable fluid;

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

The present disclosure provides systems and methods for burning emulsions including a flammable liquid. In some embodiments, a burner system of the present disclosure and associated methods enable burning emulsions that are difficult to ignite. In some embodiments, the burner systems of the present disclosure include one or more rods disposed in the enclosure holding the emulsion. In some embodiments, the burner system further comprises an adjustable throttle to transfer the collected radiative and convective heat generated by the combustion back to the fuel, to create a feedback loop which sustains a significantly increased burning rate. In some embodiments, the systems and methods of the present disclosure can help achieve sustained burning of oil emulsions as a pool fire, including in emulsions with high water content that do not otherwise achieve sustained burning. The burning may be enhanced by 5 to 8 times for emulsions with lower water content.

The liquid pool to be burned can include skimmed oil that has been emulsified with fresh water or saltwater, any flammable liquid that has been mixed with or emulsified with fresh water or salt water, or any hydrocarbon that was spilled on land or water. The hydrocarbon can be a weathered or a heavily emulsified hydrocarbon, making it difficult to achieve a sustained ignition. The hydrocarbon can also be soaked in sand or other debris. The sand-oil mixture to be burned can be added to the burner system using a conveyor belt. The sand can also be mixed with water for easy transport. Clean sand can be removed from the bottom of the burner system. It should be noted, however, that, while the instant systems and methods are described in connection with water-oil emulsions, the instant systems and methods may be used for cleaning other chemical and hazardous materials and spills.

Figure 1A:
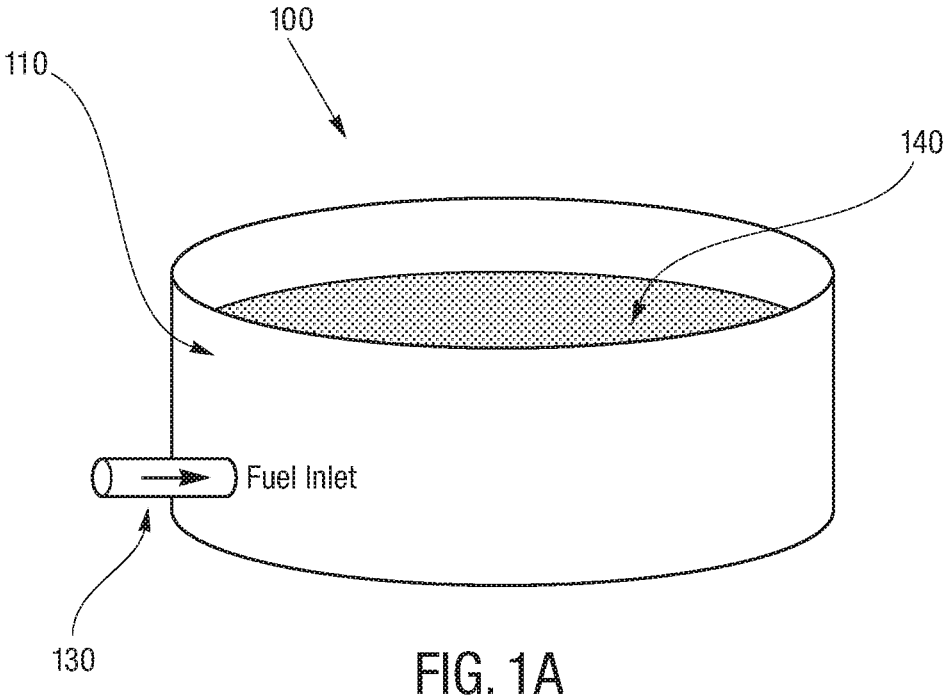
FIG. 1A illustrates a confined pool of a flammable substance such as liquid fuel.

FIG. 1A illustrates a burner system 100 including a confined pool, such as a spill bounded by a holding facility or contained in an enclosure 110 for holding one or more flammable substances 140. The flammable liquid may be supplied to the enclosure 110 through an inlet 130 to the confined pool or enclosure 110. The flammable liquid can be liquid oil, water-oil emulsion or some other type of flammable liquid fuel substance.

Figure 1B:
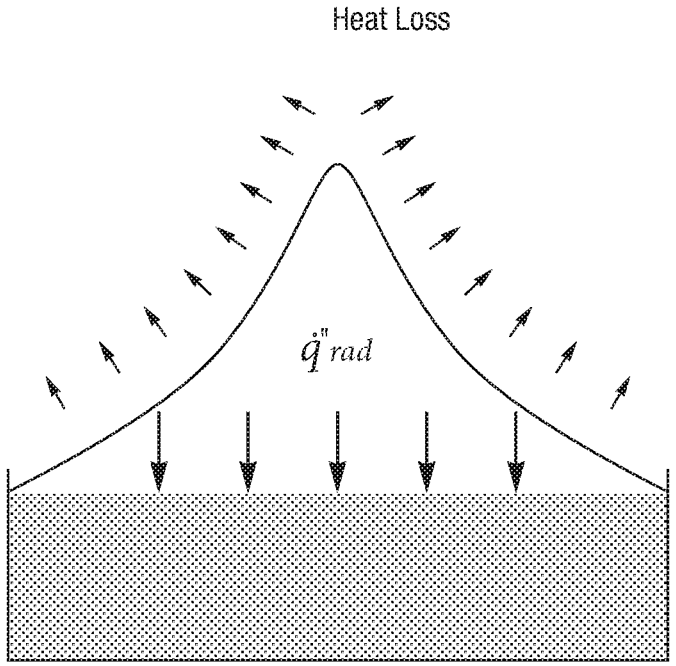
FIG. 1B shows the confined pool of a flammable substance with the heat transferred from a flame that is lost to the environment by convection and gas radiation losses.

FIG. 1B illustrates a representation of the liquid fuel heat flux from a flame that is higher at the ends or edges of the pool burner and much lower at the center of the pool burner, as the flame stand-off is higher at the center. Most of the heat transferred from the flame is lost to the environment by convection and gas radiation losses. Only a small fraction (~1-5%) of this heat goes back to the pool that sustains vaporization of the liquid fuel and consequently combustion. Because of this reason, the average regression rate in a confined pool fire varies between 0.1-5 mm/min which is fairly low, compared with existing burner designs where premixing allows higher efficiency.

In reference to FIGS. 2A-2C, the systems and methods of the present disclosure may include a plurality of conductive rods or objects disposed throughout the enclosure to enhance heat and mass transfer because in a pool fire and to increase burn efficiency. The rods disposed in the water-oil emulsion may transfer the radiative and convective heat generated by the combustion back to the liquid to create a feedback loop effectively sustaining the burning even at high water-oil emulsions. Heat transferred can be as high as 1 kW per rod, causing a corresponding increase in burning rate up to 10 times or more, depending on the number of rods.

By way of a non-limiting example, FIG. 2A shows a confined pool fire. Here, the heat flux from the flame is higher at the ends and much lower at the center, as the flame stand-off is higher at the center. Most of the heat transferred from the flame is lost to the environment by convection and gas radiation losses. Only a small fraction (~1-5%) of this heat goes back to the pool that sustains vaporization of the fuel and consequently combustion. Because of this reason, the average regression rate in a confined pool fire may vary between 0.1-5 mm/min which is fairly low, compared with existing burner designs where premixing allows higher efficiency.

FIG. 2B shows the case of a similar confined pool fire, however, with an immersed object that may be a metal rod protruding to a certain height "h" above the liquid surface. In this case, flame heats up the metal insert significantly both by conduction and radiation. The hot insert subsequently heats up the liquid fuel. Thus, additional heat is transferred through the object to the fuel to result in enhanced burning, as shown in FIG. 2C.

Figure 3A:
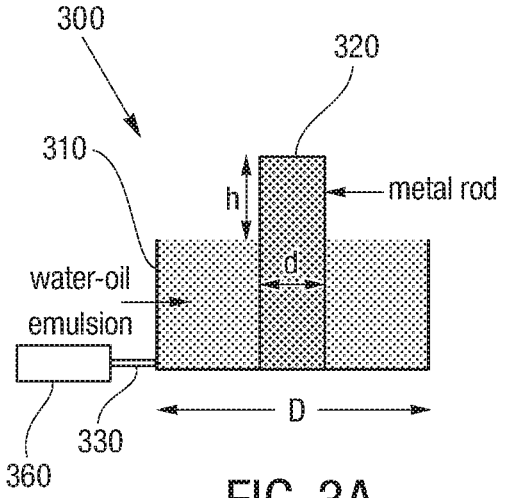
FIG. 3A illustrates an embodiment of a system of the present disclosure having a single rod.
Figure 3B:
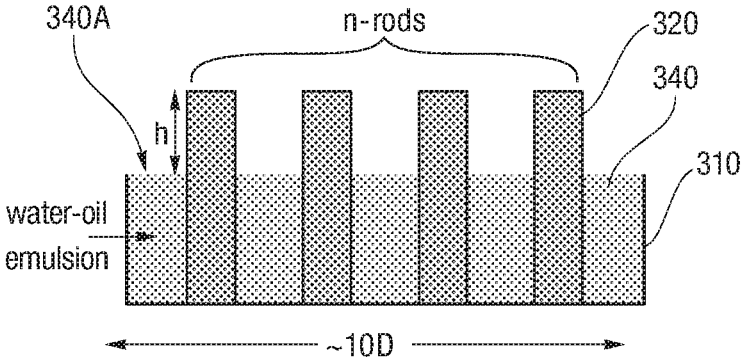
FIG. 3B illustrates an embodiment of a system of the present disclosure having multiple rods.
Figure 3C:
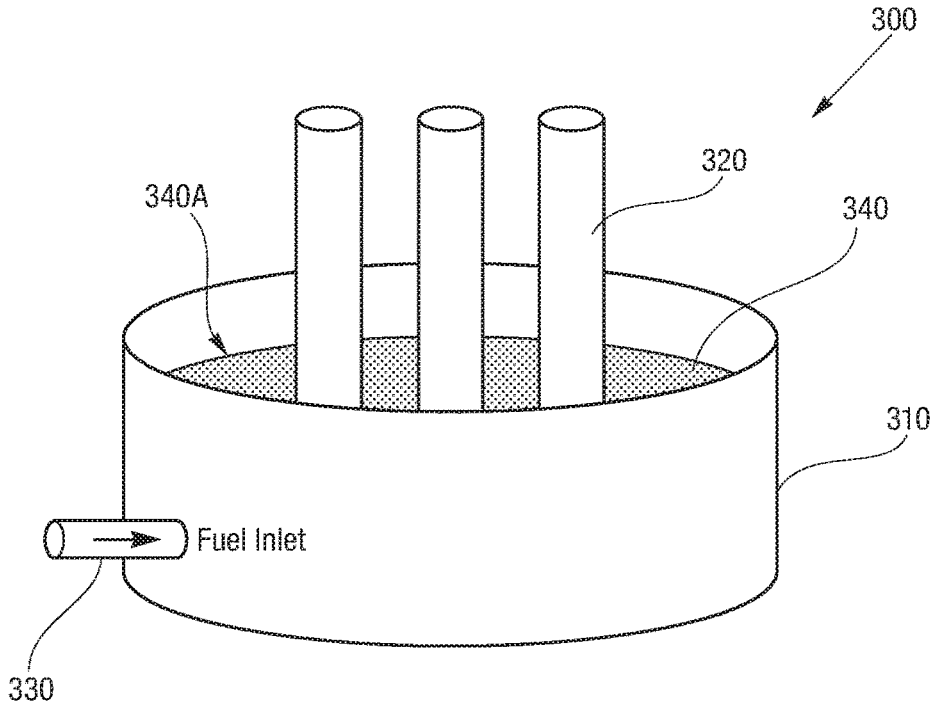
FIG. 3C illustrates a confined pool of liquid fuel having immersed rods positioned within an enclosure, according to an embodiment of the present disclosure.

In reference to FIGS. 3A-3E, in some embodiments, the systems 300 of the present disclosure may include an enclosure 310 configured to a confined pool 310 of liquid fuel 340, such as, for example, an water-oil emulsion, and one or more rods 320 disposed throughout the enclosure. FIG. 3A illustrates the confined pool of liquid fuel to be burned with a single immersed metal rod 320, while FIG. 3B illustrates the confined pool of liquid fuel having multiple immersed metal rods. As shown in FIG. 3C, the rods may be distributed throughout the enclosure, uniformly or non-uniformly. The rods may be distributed in various configurations, such as for example, circular, triangular, or square.

In some embodiments, the configuration of rods may have the same shape as the enclosure.

The enclosure 310 can have an inlet/outlet 330 through which the water-oil emulsion may be delivered or removed from the enclosure 310. In some embodiments, the systems of the present disclosure may further include a delivery system 360 for supplying the water-oil emulsion to the enclosure 310. In some embodiments, the water-oil emulsion can be continuously supplied to the enclosure 310 to maintain a desired level of the water-oil emulsion in the enclosure 310. The delivery system 360 may be one or more of the following types: a pump system, a gravity feed, in-situ pump, or similar. The rate at which the delivery system may supply the water-oil emulsion to the enclosure 310 may be set such that there is no overflow, and the flow rate matches the mass burning rate. In some embodiments, the delivery system 360 may include a control system that can be based on parameters such as pressure head within the enclosure 310, temperature at a location, flame height, and or heat flux.

Figure 6:
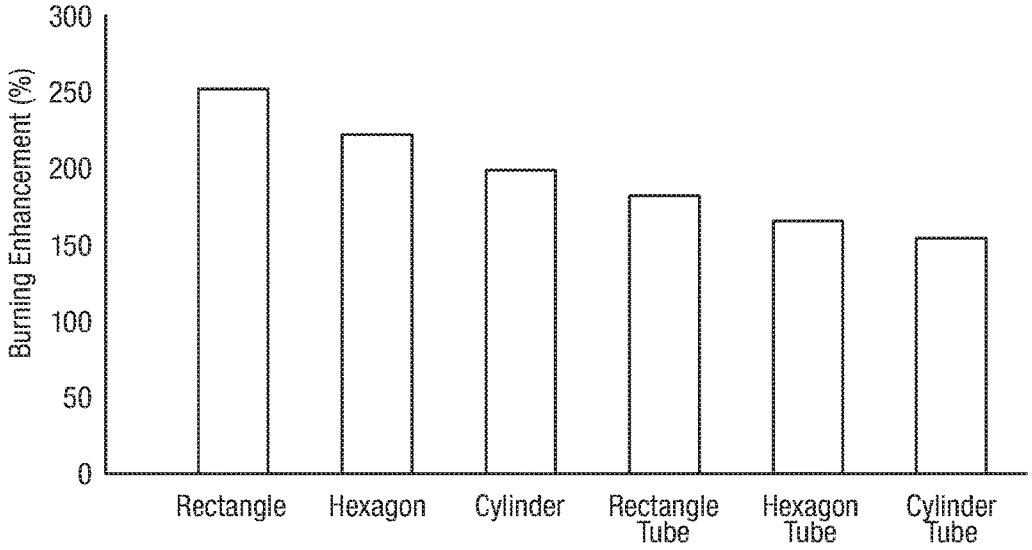
FIG. 6 illustrates an effect of rod shape on burning efficiency.

The rods 320 may have different shapes, including, but not limited to, round, square, hexagonal oval, independent of other rods in the enclosure 310. The shape of the rods 320 may impact the rods impact on burning rates, as may be seen in FIG. 6. The rods 320 may have shapes including a linear and non-linear shape, uniform or non-uniform shape, one or more protrusions that are one of linear and/or non-linear shape that extend from an outer surface of the rod. It is contemplated the rods 320 may have a shape from a group consisting of a mushroom shape, a wave shape or a spiral shape. It is possible the rods 320 may have a textured surface, smooth surface or some combination thereof. In some embodiments, CFD (Computational fluid dynamics) model can provide a relationship between flame exposed rod height and immersed rod height.

The rods 320 may be formed from a variety of heat conductive metallic or non-metallic materials, including but are not limited, to aluminum, copper, steel, carbon, and similar materials. The rod material may also be an alloy or a combination of different materials (inner-outer or upper-lower). For example, aluminum has very good thermal diffusivity ($731\times10^{-7}$ $m^2/s$) and good heat resistance (melting temperature of 916 K compared with the typical gas temperature in the flaming region of 1100 K). Copper also has very good thermal diffusivity ($1.1\times10^{-4}$ $m^2/s$) and good heat resistance (melting temperature of 1325 K compared with the typical gas temperature in the flaming region of 1100 K).

In some embodiments, the rods 310 may be adjustable, that is, the height "h" of the rods above the liquid surface 340A may be adjustable. The height of the rods 320 may depend on the percentage of the water in water-oil emulsions, among other variables. In some embodiments, the burner systems of the present disclosure may be configured to monitor and control the burner systems in real time. The burner systems of the present disclosure can be instrumented with a smart control system that may include a data acquisition system to monitor the temperature of rods and a controller to optimize the "h" value.

Figure 3D:
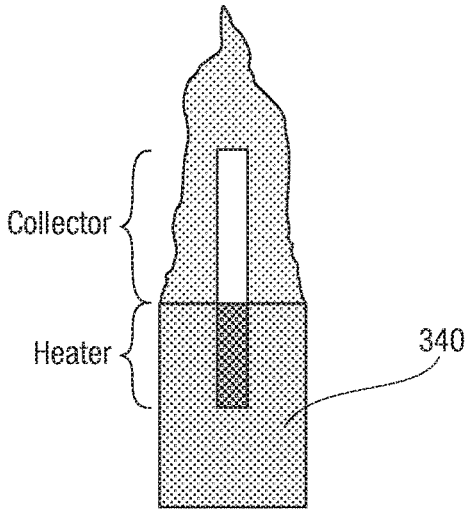
FIG. 3D illustrates a rod with a collector section and a heater section.

Referring to FIG. 3D, the rods may comprise two sections, a collector section which comprises the portion of the rod that is above the level of the fuel 340, and a heater section which is positioned within the level of the fuel 340. The collector collects heat energy from a flaming region of the fire and transfers it to the heater, which is submerged inside the fuel layer and transfers the heat energy to the liquid fuel. An enhancement of burning rate in the case of a pool fire may result due to nucleate boiling at the surface of the heater. In some embodiments, collector to heater height ratio may be between 2 and 6. In some embodiments, the ratio may be between 3 and 5, and in some embodiments the ratio is 4.

Given a material type chosen for the rod 320, based on the thermal conductivity, specific heat, density, and the melting point, the burning rate may be controlled by varying one or more of such parameters as height of the collector above the liquid layer (shown by h in FIG. 3A), the number of rods (denoted by n) and placement of the rods 320. The diameter (d) of the rods 320 can be based on structural considerations and desired heat conductivity. An increase in the height, h, and number n enables more heat to be transferred to the liquid fuel, thereby increasing the mass-burning rate. However, the distribution of the rods 320 and height of each rod 320 may need to be optimized since heat transfer from the flame to the fuel surface is not uniform Thinner rods (lower diameter) [D] are preferable as they can heat up quickly. In some embodiments, the height of the rods 320 may be in the range of expected flame height. In some embodiments, the rods 320 may be affixed to the bottom of the enclosure by any known technique. In some embodiments, floatable rods may be used.

Figure 3E:
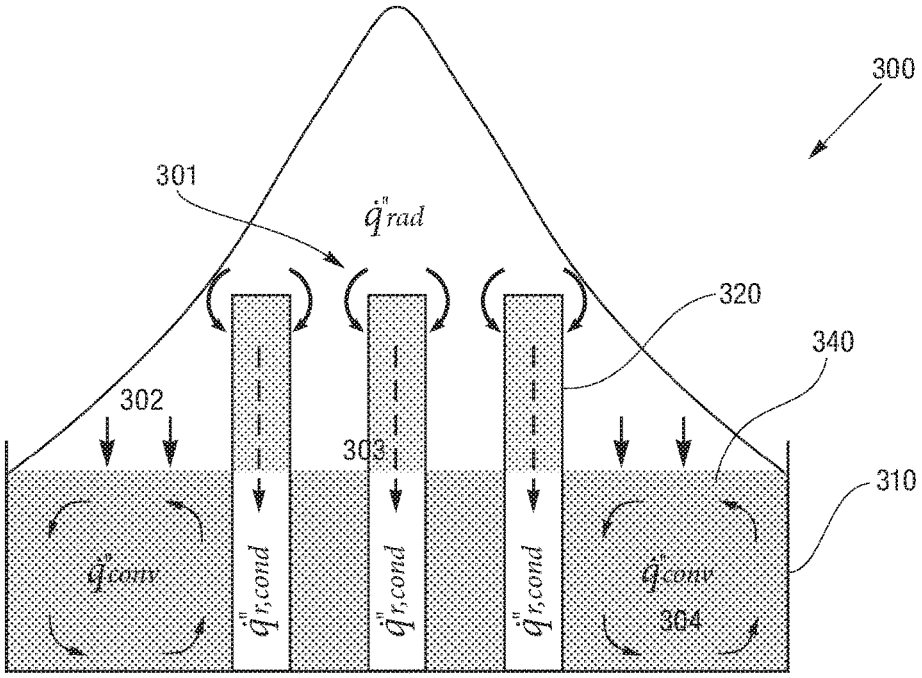
FIG. 3E illustrates the heat transferred from the immersed rods that direct the radiative and convective heat generated by the combustion back to the liquid fuel, according to some embodiments of the present disclosure.

FIG. 3E shows the impact of the immersed metal rods 320 on heat transfer from a flame that heats up the metal rods 320, both by conduction and radiation. Arrows 301 and 302 show the radiative heat transfer from flame to the rods and to the fuel surface, respectively. Arrows 303 show the conductive heat transfer from top of the rod through the immersed section, while 304 shows the convective heat transfer from immersed section to the fuel. This feedback system may improve the evaporation rate, thereby increasing the mass burning rate and further enhances the heat received by the metal rod 320 from the flame.

The hot adjustable rods 320 subsequently heat up the liquid fuel 340 in the pool burner. Thus, additional heat may be transferred through the hot adjustable metal objects or rods 320 to the liquid fuel 340 as shown in FIG. 3E. A major part of the heat lost to the environment in the form of flame radiation and convection can now be used to heat the adjustable metal rods 320. Further, Marangoni effects and Rayleigh convection, cause liquid-phase motion, improve mixing and further increase the heating rate and therefore the burning rate. This heating is proportional to the geometry of the object, and material properties such as thermal diffusivity. In some embodiments, the enhancement can be as high as 100-600%. In other words, with an optimal position and geometry of one or more adjustable metallic objects 320 inserted in confined pools, the average regression rate can reach up to 250 mm/min that is 100 times higher than current burner designs. Additionally, the heat that is produced by the fire, is not wasted through convection and radiation to the ambient, but efficiently used to vaporize the fuel 340. Further, the adjustable rods 320 can provide for an enhanced ability to direct the radiative and convective heat generated by the combustion back to the liquid fuel 340 to create a feedback loop effectively to sustain the burning efficiency even at high liquid fuel-non-fuel emulsions, i.e. water-oil emulsions. In a confined pool fire, the mass burning rate is a function of emulsion type, ullage (fuel level) and environmental conditions (ambient temperature, wind, moisture, etc.). In this context, linear actuators can be integrated into a sophisticated control system to provide precise position feedback and accurate control of the rod height. From ignition of the fuel, temperature of the fuel and rod can be monitored in real time. By using the temperature data, the smart control system can send signals to linear actuators. As an example, if the data acquisition system senses a decrease in fuel temperature, controller can be prompted to adjust the current signal on the linear actuators to optimize the rod height.

In some embodiments, a maximum burning efficiency may be achieved when the rods are fully exposed to flames. When the rods are fully exposed to the flames, the flame height of the baseline case is about 2, about 3 or about 4 times the optimum rod height. In some embodiments, the rod height is from 25% to 75% of the baseline flame height (i.e height of the flame without rods). In some embodiments, the optimum rod height is from 30% to 60% of the baseline flame height, and in some embodiments half of the baseline flame height.

Figure 3F:
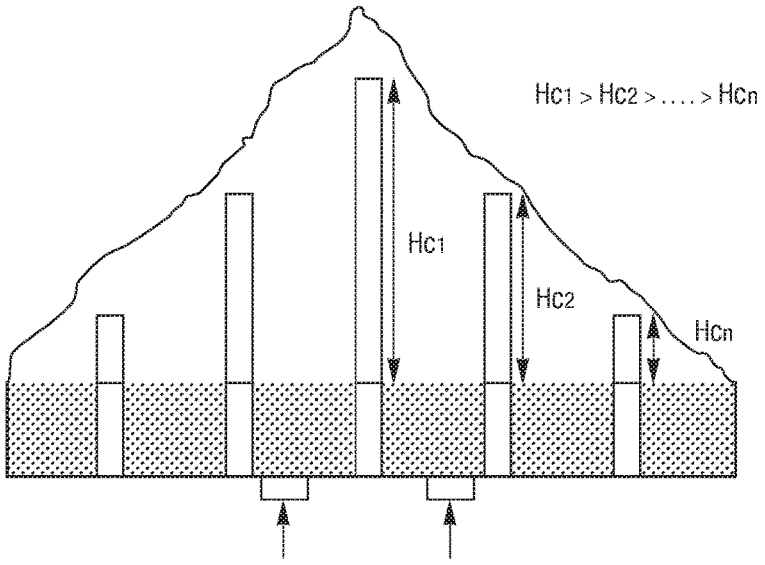
FIG. 3F illustrates one embodiment of the system with varying rod heights.

In reference to FIG. 3F, rod height may also vary within a given system, depending on the shape of the flame for example. In some embodiments, the rods may be divided into multiple zones having rods of different heights depending on the expected flame height in the zone. For example, the rods located at an edge of the enclosure may have a shorter height that the rods in a middle of the pool being higher, so that the rods make contact with the flames. Additional zones may be designed. The zones may, for example, have the same shape as the enclosure and may be concentric with one another, and the enclosure.

The total collector area can be adjusted in at least three different ways: a) changing the height of the rod, b) changing the number of rods and c) adding fins, groves, dimples, or changing surface area to volume ratio. Optimum rod with height can be determined by comparing a steady state mass loss rate and a temperature profiles against a baseline case with no rods. Collector height (H) can be determined when rods are placed in the pool of fuel and the mass loss rate is measured compared to baseline. Any increase over the baseline case is because the rods are directing the heat from the fire back to the liquid fuel. With an increase in H, the collector area increases. This area increase can cause the net heat flux transferred by the rods to the pool to increase as more heat is collected by the collector. At some point the mass burning rate reaches an optimum value. As H is further increased beyond the optimum value, the burning rate lowers. Given a pool diameter, fuel type, rod height, material and rod shape, an optimum collector height is used to maximize heat transfer. A collector output (watts) can be defined given these controlling parameters which can then be used in a burner design for scaling purposes.

A mathematical relationship can be used to determine rod number, rod height and collector height for a given rod material, fuel material and a pool surface area. For a given material type, a ratio of net flame exposed collector area to the pool surface area can be used to scale-up the number of rods. The collector height can be from 60% to about 95% of the height of the rod. In some embodiments the collector height can be from 70% to about 85% of the height of the rod. In some embodiments the collector height is 80% of the height of the rod.

Many rod configurations are possible, with different number of rods depending on the size of the enclosure and potentially safety concerns. Immersed rods may significantly enhance the mass loss rate of the confined pool fire. In general, the higher number of rods may result in higher loss rate. For example, 3 rods increases the mass loss rate about 580%, while 5 rods may enhance the burning 900%, respectively, over the baseline case. With a larger diameter pool fire, it is expected that the efficiency may be higher due to an increase in the radiative heat flux from the fire.

The mass loss rates (MLR) of the burner with and without air inlets varies. Mass loss increases with air inlets. Correspondingly, the emissions may also improve as greater premixing through additional air inlets will enable less smoke, and unburned by-products. The burner with immersed rods and air inlets may increase the MLR from 100% to about 400% over the baseline case. In some embodiments the mass loss increase is 300%. In some embodiments, air inlets may decrease the flame height, thus increasing efficiency of the system. The immersed rods with air inlet enhances crude oil burn rates and in some embodiments reduces smoke and other unburned by-poducts, especially for emulsions where the water content is of a sufficient concentration that ignition and maintained burning is difficult.

Figure 4A:
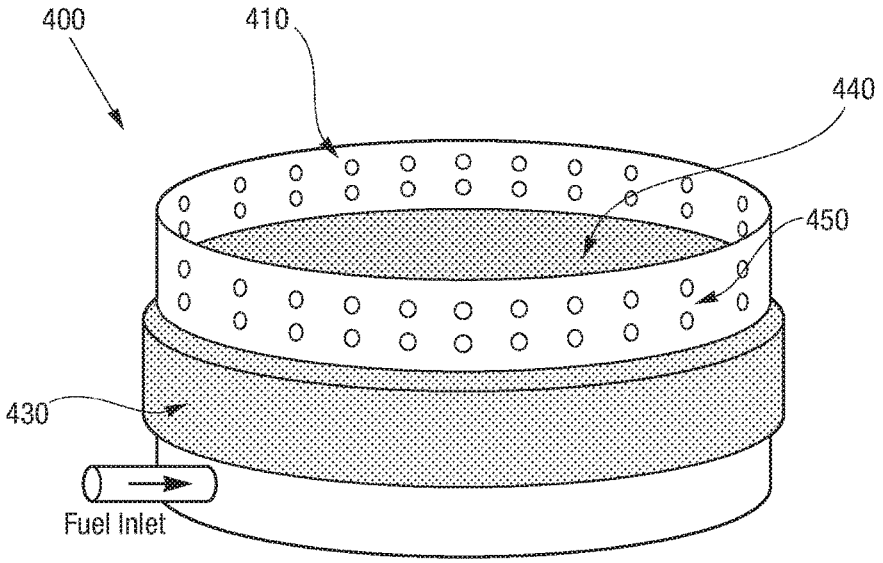
FIG. 4A illustrates a confined pool of liquid fuel having an enclosure with adjustable air holes, according to some embodiments of the present disclosure.

In reference to FIG. 4A, in some embodiments, to enhance burning of a flammable liquid, the enclosure 410 of the present disclosure may include air-inlets 450. In some embodiments, the methods of the present disclosure may include one or more of the following steps: providing a flammable liquid to an enclosure 410 having one or more air inlets, disposing one or more conductive nonflammable objects in the enclosure 410 holding the flammable liquid, and burning the flammable liquid in the enclosure 410 as a confined pool fire. The present methods may further include collecting water-oil emulsion and transferring the emulsion to an enclosure 410 explicitly for combustion.

Figure 4B:
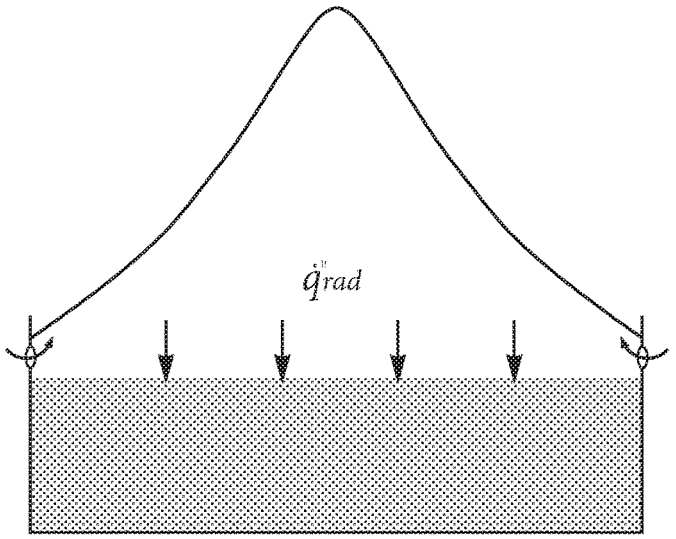
FIG. 4B shows a heat transfer diagram for an enclosure with air inlets of the present disclosure.

FIG. 4A, shows the burner systems 400 of the present disclosure including an enclosure 410 configured to hold the water-oil emulsion 440 and air inlets 450 disposed throughout the enclosure 410. In some embodiments, the air inlets 450 may be adjustable. As illustrated in FIG. 4B, the air inlets in the enclosure may optimize the air entrainment rate to enhance the burning efficiency, as is further illustrated in FIGS. 7A-7C.

Figure 4C:
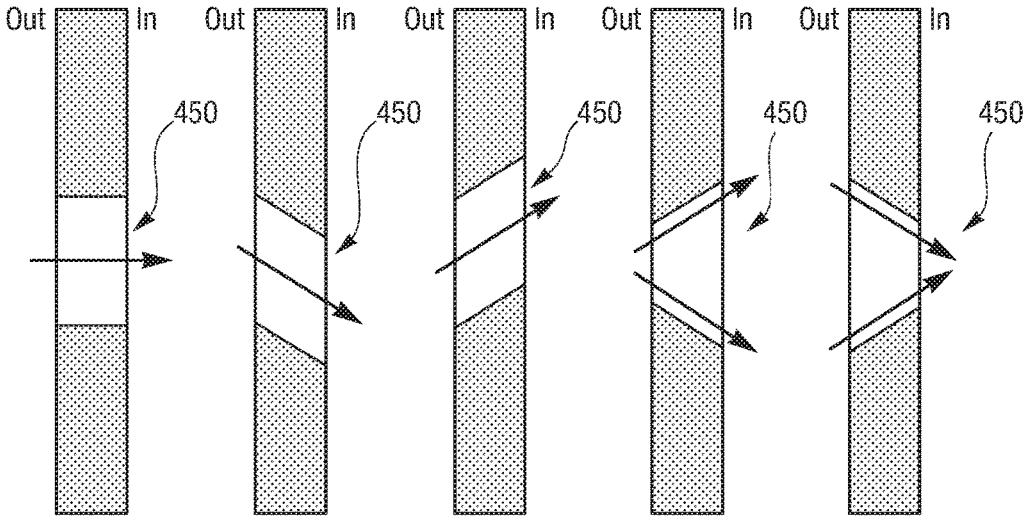
FIG. 4C illustrates non-limiting examples of different patterns of air inlets of the present disclosure.

FIG. 4C shows exemplary patterns for air inlets 450. In some embodiments, such patterns can create a throttle that allows higher velocity ambient air to be drawn deeper and mix more thoroughly into the burner to enhance burning. Further, the air inlets 450 may be fixed, adjustable or some combination thereof.

Figure 4D:
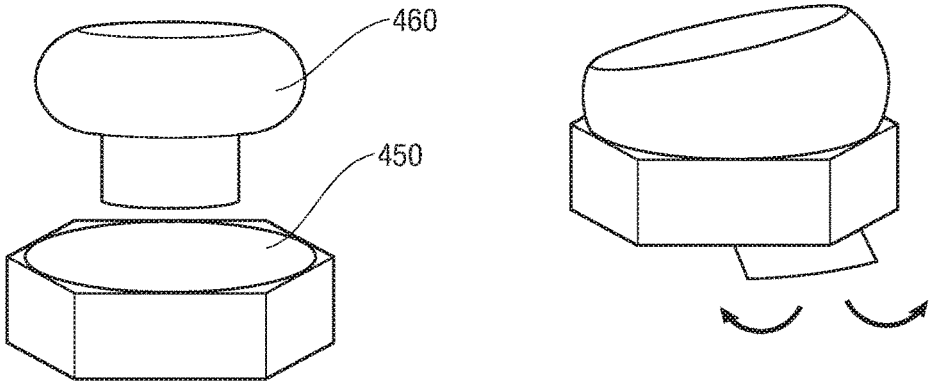
FIG. 4D shows an embodiment cover mechanism for air inlets of the present disclosure.

In reference to FIG. 4D, in some embodiments, the air inlets 450 can be provided with a mechanism 460, such as cover, to close or open the air inlets or change the shape of the air inlet 450 as the burning conditions change. By way of a non-limiting example, FIG. 4D shows the adjustable ball fittings that can be used to change the shape of the air inlet 450 to control direction of in-coming air. It is contemplated that a control algorithm may be utilized to use temperature feedbacks to adjust the number (close or open certain inlets) or shape of air inlets 450. A data acquisition system can be used to measure the temperature of the fuel and the immersed rods. Moreover, anemometers can be placed to the air inlets to measure the air flow. Anemometer data and temperature distribution through the fuel and rods can be used as input to generate output signal, which controls the air inlet covers. The objective is to optimize the air flow to sustain a desirably high burning rate. For example, the burner can be operated either as a passive or as an active burner. In active cases, the number of air inlets can be changed by actuators to optimize the burning efficiency. Specifically, this unique aspect to the present disclosure can allow for the burner to remain operable as a passive burner even when the control feedback components are not functioning properly.

Figure 5A:
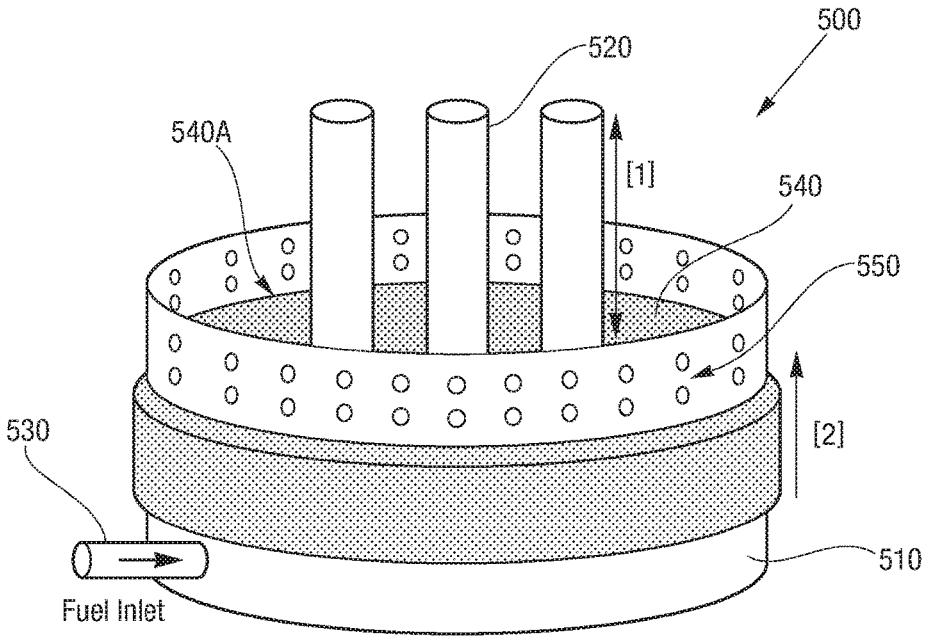
FIG. 5A shows a system of the present disclosure having one or more adjustable rods and adjustable air inlets, according to some embodiments of the present disclosure.
Figure 5B:
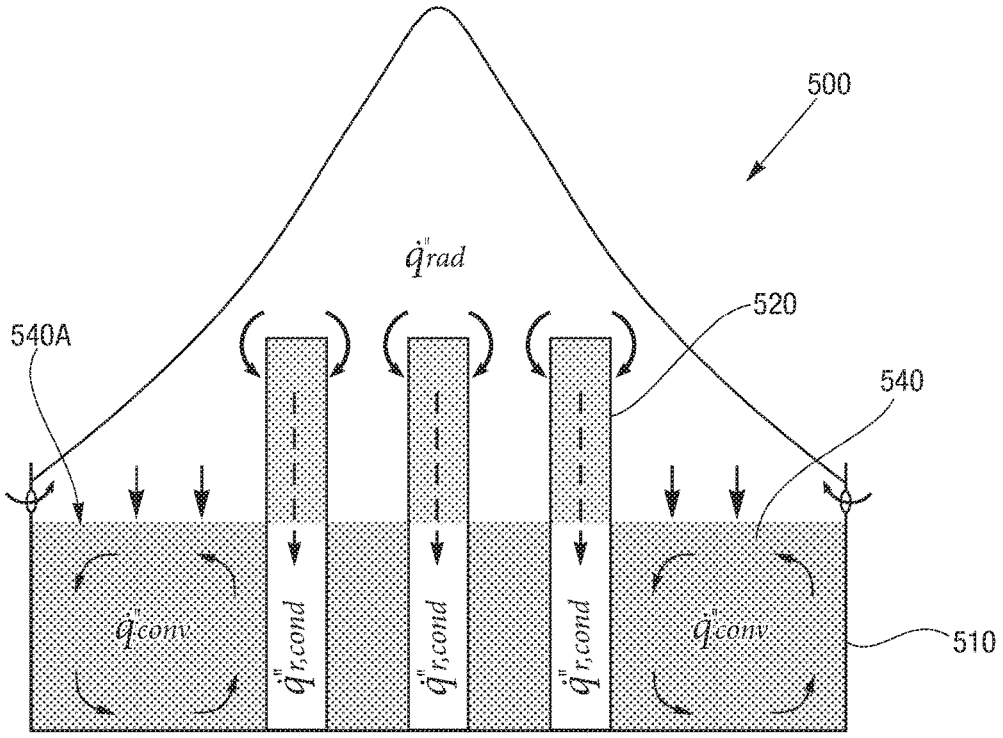
FIG. 5B illustrates a representation of the heat transfer while burning fuel in a an enclosure with immersed rods and adjustable air inlets of the present disclosure.

Referring to FIG. 5A and FIG. 5B, in some embodiments, the system of the present disclosure may include the rods 520 and air inlets 550. The systems 500 of the present disclosure may include an enclosure 510 with a fuel inlet 530 configured to hold the water-oil emulsion 540 having an water-oil emulsion surface 540A, one or more rods 520 disposed throughout the enclosure 510 and air inlets 550. The rods, air inlets or both can be adjustable.

FIG. 5B illustrates a representation of the heat transferred from the immersed rods 520 that direct the radiative and convective heat generated by the combustion back to the liquid fuel 540, while the adjustable air inlets 550 optimize the air entrainment rate to enhance the burning efficiency. As can be seen in FIG. 5B, the air inlets 550 allowed air access to the flame through the side of the enclosure.

Because the water-oil emulsion with high water content may be hard to burn, as discussed, above, the systems of the present disclosure may further include hot igniters and accelerators, such as gelled fuel mixtures or similar. In some embodiments, the rods may be preheated before igniting the water-oil emulsion.

Usually boil-over happens because of evaporation of a water sublayer, which could result in fire enlargement and formation of fireball and ground fire. This can be prevented by optimization of the rod height and number. Additional precautionary measures such as demarcation of a safe separation distance during the burner operation can be determined. Nucleate boiling may be a reason for enhancement of the burning rate. The heat transfer inside the liquid may be significantly enhanced because of tiny bubbles or local boiling sites that are developed on the surface of the rods.

In some embodiments, because the heat flux from the flame to the fuel surface may be non-uniform, multiple rods placed in the fuel may be heated non-uniformly. In some embodiments, one or more of the rods can be preheated or additional heat may be added during burning to ensure uniform heating of the rods.

Further, soot deposition on the rods may also be uneven which may lead to unsteady behavior after some time duration. Soot deposition in the enclosure may also impact the efficiency of the instant systems and methods. To combat that problem, a variety of methods for management of soot deposition may be employed. In some embodiments, the rods may be of different heights strategically located in the enclosure. This can be determined from intermediate and large scale experiments that can be performed in enclosure sizes from 0.5-5 m diameter [D] size range.

For example, in case of salt water oil spills, once the oil is released (leaked) to the sea, it tends to emulsify with water within a few minutes of being spilled and a highly viscous and stable emulsion is formed within hours. After about one day, the water content in the oil emulsion can reach up to 70%. Field experiments in Barents Sea show that oil emulsifies slower (40% water content after 6 days) in dense pack ice than on open water (80% after a few hours). However, there can always be a certain content of water (0-70%) in the oil emulsion recovered by the skimmers in the Arctic. Oil emulsions are difficult to burn when its water content is in excess of 25% because the maximum water content that can be removed by boiling with the limited heat flux fed back to the pool by the flames in open pool fires is only about 20-30%.

The systems and methods of the present disclosure may allow burning water-oil emulsions with water content between less than 30% to up to about 70%. In some embodiments, the water content may be between 20% and 70%, 25% and 70%, 30% and 75%, 35% and 70%, 40% and 70% and 50% and 70%. In some embodiments, the water content may up to 60%, such as between 20% and 60%, 25% and 60%, 30% and 60%, 40% and 60% and 50% and 60%.

By adding heat supplied by the immersed noncombustible and conductive rods 320 back to the spill, a significantly larger fraction of water can be removed directly. Heat also can help break the water-oil emulsion by improving the water droplet coalescence. Larger water droplets settle through the emulsion layer and leave water-free oil layer on top of emulsion. If the rate of emulsion breaking is higher than the rate of oil layer vaporization, sustained combustion can be achieved. Due to the heat feedback from the rods high water content (~70%) oil emulsions can also be burned away. In some embodiments, the systems and methods of the present disclosure may be used to burn water-oil emulsions at cold temperatures (−40-0° C.). In some embodiments, the present methods, systems and devices may be used for cleaning up oil spills at reduced temperatures such as those found in the Arctic seas.

It is likely that enhanced burning rate can promote higher flame temperatures thereby aiding in complete combustion of the fuel and reducing quantity of unburned products of combustion. The initial heating of the rods stage may cause an increase in the emissions because they can act as a heat sink during the initial stages. Accordingly, in some embodiments, the systems of the present disclosure are equipped with exhaust systems.

In operation, the water-oil emulsion may be supplied to the enclosure having one or more air inlets, rods or both via the pump system. Once a desired level of the water-oil emulsion is achieved, the flame may be ignited. In some embodiments, the current approach uses diffusive burning where fuel and air are not mixed initially. As the oil is burnt, the pump system may add additional water-oil emulsion to maintain the desired level of fuel in the enclosure.

As noted above, the height and number of rods as well as shape and number of air inlets may impact the burning rate of the flammable liquid in the pool. These parameters may be optimized for specific conditions using Computational Fluid Dynamics (CFD). For example, a commercial 3-D CFD tool, ANSYS-Fluent, can be used to solve for transient flow, heat transfer, and evaporation of the oil and water emulsion within a pool fire burner, determining optimum combinations of cylinder height, cylinder diameter, and cylinder spacing.

The systems and methods of the present disclosure are described in the following Examples, which are set forth to aid in the understanding of the disclosure, and should not be construed to limit in any way the scope of the disclosure as defined in the claims which follow thereafter. The following examples are put forth so as to provide those of ordinary skill in the art with a complete disclosure and description of how to make and use the embodiments of the present disclosure, and are not intended to limit the scope of what the inventors regard as their invention nor are they intended to represent that the experiments below are all or the only experiments performed. Efforts have been made to ensure accuracy with respect to numbers used (e.g. amounts, temperature, etc.) but some experimental errors and deviations should be accounted for.

EXAMPLES

A total of 11 experiments were performed with fresh water content at 25%, 40%, 60% and 60% salt water. Baseline tests were performed to quantify the enhancement in burning rate due to the rods. For 40% and 60% fresh water-oil emulsions, tests were repeated by increasing the number of rods. 37 (CP=0.21) and 59 (CP=0.33). 1 cm diameter copper rods with 32 cm (12.5") collector and 14 cm (5.5") heater heights were used in large-scale tests. One series of tests with salt-water emulsion (60% salt water) was also performed to simulate the worst-case scenario.

Emulsion Preparation.

Because of the larger volume of oil necessary for the large scale prototype burner design, the emulsion apparatus developed during Phase II was modified by adding an additional mixer and barrel. The ANS crude oil and fresh water were added in two 31-gallon containers. Drill-mounted paint mixers with a speed of 1000 rpm were used to mix the emulsion. A 10 gal/min rotary pump was then used to recirculate the emulsion. All emulsions were mixed for 12-15 hours.

The same procedure was followed to prepare the salt-water emulsion. The emulsion was prepared with 35 ppt (parts per thousand) saline water. The salt water was slowly poured into the pail so that it was drawn into the suction of the pump along with the oil. The emulsion was mixed for 12-15 hours. The stability of emulsions was tested by extracting a sample of the oil water mixture in a beaker and measuring the time needed for the water-oil to separate. For all cases, the separation was occurred in 1 hour after stopping the emulsion system. Amount of the prepared emulsion (45-50 gal) contributed to the fast separation. In this context, prepared emulsion was directly transferred into the burner and burned within 30 minutes.

Experimental Setup.

A 100 cm diameter steel burner with 15 cm depth was manufactured with a total liquid volume of 117 liter (31 gallons). Fuel level was kept constant at 14 cm during the tests. The burner was equipped with a cooling jacket that had a maximum flow capacity of 12 lt/min (31 gal/min). In a field trial, the cooling jacket may comprise of the water-oil emulsions itself (instead of water) to preheat the emulsion thereby increasing burner efficiency. Two 5 cm (2") diameter perforated inlet pipes were used to uniformly supply the emulsion into the burner. Homogenous distribution of the cold fuel into the hot system increases the efficiency of the burner by preventing rapid fuel temperature decrease at the inlet zones. Two 5 cm (2") diameter pipes were used to drain the fuel out, allowing for quick extinction of the flame by draining the burner quickly. The fuel was drained into metal containers, which made the cleaning process easier. Further, crude water-oil emulsion samples were extracted real time during the burn for analysis as would occur when the burner is deployed in the field.

Two omega FPU5MT peristaltic pumps were used to feed the burner. The pumping rate, which is equal to the mass loss rate, was adjusted to keep the fuel level constant in the fuel level observation pipe. The weight of the fuel supply (5-gallon pail) was continuously monitored by a load cell providing a fuel consumption rate (g/min). A containment box using flame resistant tarps was manufactured to contain any spilled oil.

A total of 59 TCs were used to measure the temperature distribution both within the oil emulsion and the rods (also referred to as FR). A circular rod pattern was used in large-scale experiments. The rods at the center were instrumented with 34 TCs. TC's were embedded into the rods with 1.3 cm (0.5") spacing to measure the temperature gradient. 9 TCs were placed into the external rods. 2 TC arrays with 8 TCs each were used to measure the temperature distribution within the fuel. The first fuel TC array was placed 10 cm (4") away from the center, while the second one was 36 cm (14") away from the center to investigate the horizontal temperature variation.

Five Medtherm 64P-xx-24 type (Four 50 kW/m$^2$ and one 100 kW/m$^2$) Heat Flux Gauges (HFGs) were used to measure heat flux from the flame to the surface of the fuel and to the ambient. Two HFGs with 50 kW/m$^2$ capacity were placed slightly above the pool surface to measure the radiative flux directed from Rods to the pool surface. The first one (50 kW/m$^2$) was placed 10 cm (4") away from the center, while the second one (50 kW/m$^2$) was 36 cm (14") away from the center. Three additional HFGs were placed 2.5 m (100") away from the burner with its measuring surface facing the flame. The vertical distance between the external HFGs was 38 cm (15").

Measuring the radiative heat flux directed from flames to the pool surface by using immersed HFGs is another unique approach that was used. Due to harshness of the testing conditions such as limited space, intense fuel, and flame temperatures, a special temperature and flame resistant cover was designed for immersed HFGs. HFGs are equipped with a three layer cover that consists of fiber wool (with a thermal conductivity of 0.035 W/mK), and thermal paste (Cotronics 907 regular grade adhesive k=0.865 W/mK) for heat protection and fire barrier (3M brand) for flame protection. During experiments, HFGs were cooled with ice water.

Example 1

25% Fresh Water-oil Emulsion

Figure 7A:
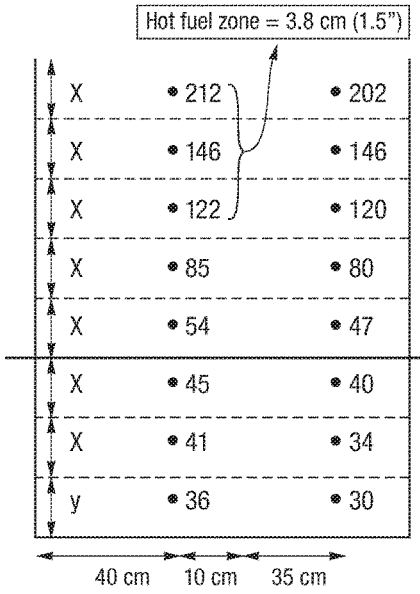
FIG. 7A and FIG. 7B illustrate a temperature distribution within a 25% fresh water-oil emulsion.
Figure 7B:
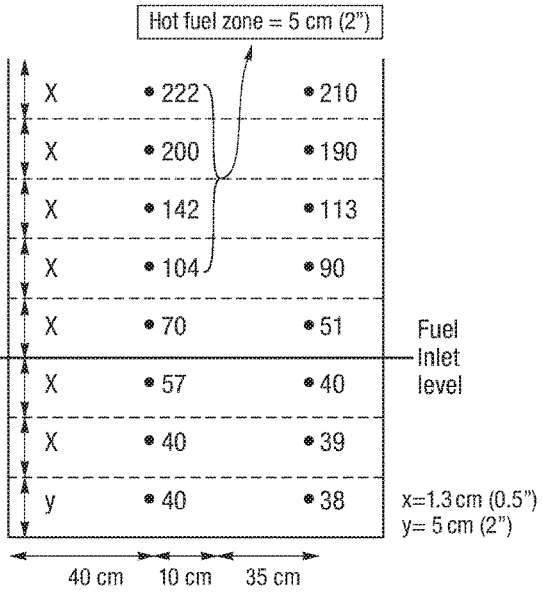

Two tests were performed with 25% fresh water-ANS crude oil emulsion: (1) baseline (no rods) and (2) with 37 rods. FIGS. 7A-7B shows the temperature distribution within the 25% fresh water-oil emulsion for the baseline and "with 37 rods" cases, respectively. Each number in FIGS. 7A-7B denotes the average temperature (100 s) captured during the steady state burning period.

For the baseline case, the radiative and convective heat generated by the combustion was able to heat the fuel above 100° C. up to a depth of 3.8 cm (1.5") below the fuel surface (FIG. 7A). The depth of the "hot fuel zone" (fuel temperature >100° C.) increased from 3.8 cm (1.5") to 5 cm (2") with the use of rods of 1 cm diameter, 37 copper rods as shown in FIG. 7B.

The mass loss rates (MLR) of the baseline and "with rods" cases are 600 g/min and 1100 g/min, respectively. The rods increased the mass loss rate (MLR) about 183%, over the baseline case. Note that the CP ratio is 0.21, which is around three times less than the small-scale and intermediate-scale tests. The reduction in rods number was compensated by the high thermal conductivity of copper.

Figure 8A:
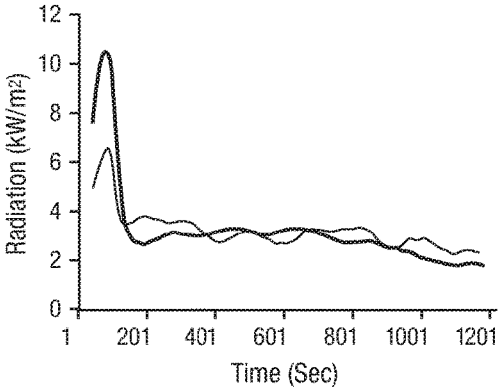
FIG. 8A and FIG. 8B illustrate an embodiment of a measurement of a flame immersed (centerline) and external heat flux gauges (HFG's)
Figure 8B:
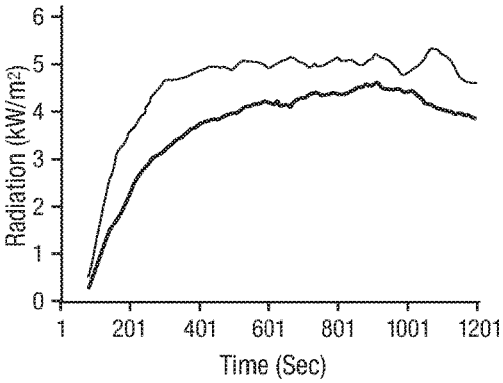

FIGS. 8A and 8B show the measurements of the flame immersed (centerline) and external HFG's, respectively. The HFG data supports the observations from intermediate-scale tests. The radiative heat flux measured by the sensors are almost same for the baseline and "with 37 rods" cases. It is demonstrated that the radiative heat was absorbed by rods and then transferred to the fuel by conduction and convection. Thermal radiation levels are similar even with nearly two times the burning rate.

Example 2

40% Fresh Water-oil Emulsion

Figure 9A:
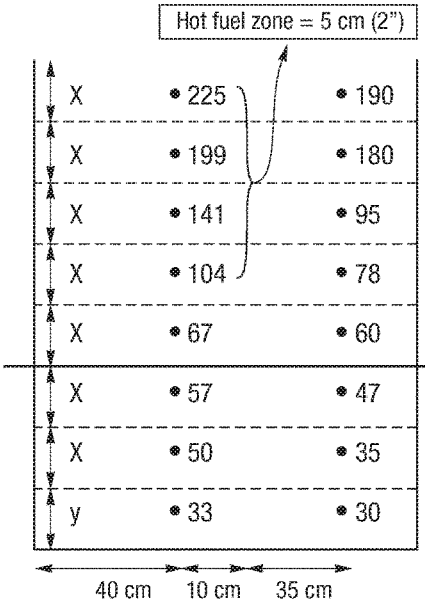
FIGS. 9A-9C illustrate a temperature distribution within a 40% fresh water-oil emulsion.
Figure 9B:
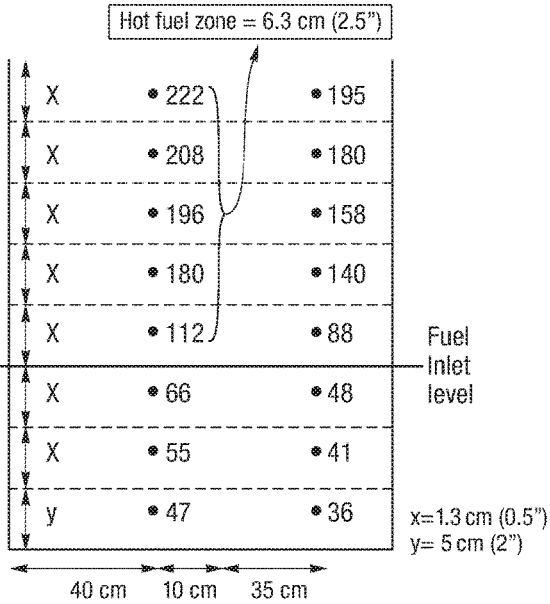
Figure 9C:
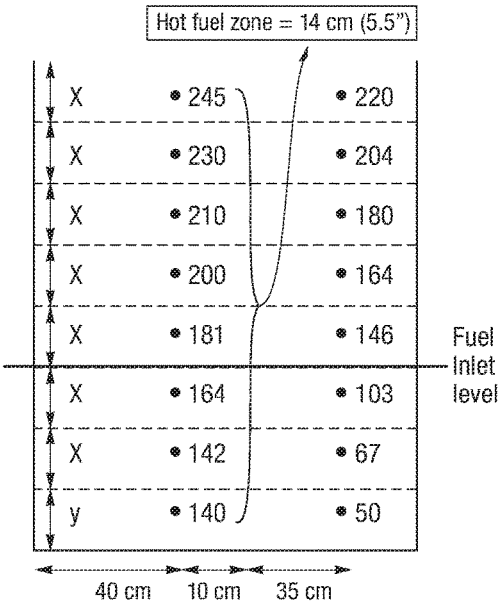

FIG. 9 shows the temperature distribution within the 40% fresh water-oil emulsion for baseline (FIG. 9A), "with 37 rods" and "with 59 rods" cases, respectively. As shown in FIG. 9B, with the usage of 37 rods, the depth of the "hot fuel zone" increases from 5 cm to 6.3 cm. When the number of rods is increased from 37 to 59, the hot fuel zone extends up to the depth of the burner as shown in FIG. 9C. The baseline value for the burning rate of a 40% water-oil emulsion is 400 g/min. With 37 rods the burning rate increases to 750 g/min. When 59 rods are used, the mass burning rate increases to 3100 g/min. This is an approximately 780% increase in MLR over the baseline case. The flame height was also enhanced about 400% when compared with the baseline case. Much higher enhancement of burning rate is possible with the larger scale prototype burner by increasing the density of the rods.

Example 3

60% Fresh Water-oil Emulsion

Figure 10A:
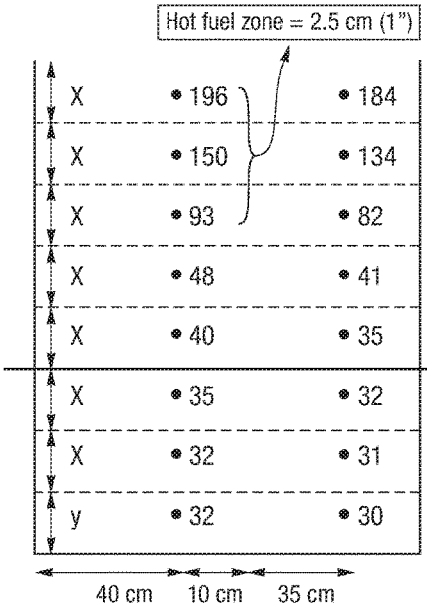
FIGS. 10A-10C illustrate a temperature distribution within the 60% fresh water-oil emulsion.
Figure 10B:
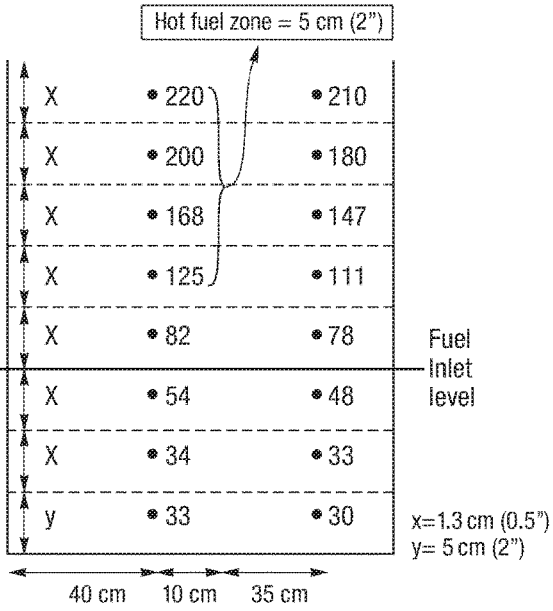
Figure 10C:
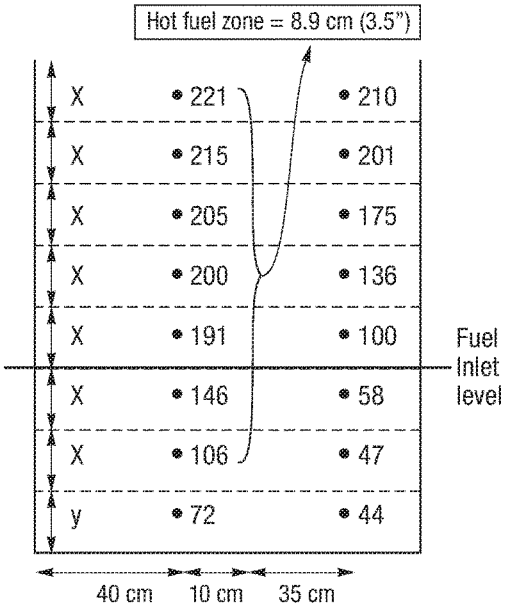

Unlike the intermediate-scale tests, 60% fresh water-oil emulsion was able to be ignited by a flame torch without need of starter. This is probably because the 60% emulsion is relatively unstable. FIGS. 10A-10C shows the temperature distribution within the 60% fresh water-oil emulsion for baseline, "with 37 rods" and "with 59 rods" cases, respectively. With the addition of 37 rods, the "hot fuel zone" increases 2.5 cm (1") to 5 cm (2"). It is observed that almost all of the fuel in the burner reaches the "hot fuel zone", when the number of rods is increased from 37 to 59. As discussed before, high thermal conductivity of water also contributes to greater heat penetration. The MLR of the baseline, "with 37 rods" and "with 59 rods" cases are 170 g/min, 310 g/min and 1100 g/min, respectively. The 59 rods increased the MLR about 650%, over the baseline case. After the completion of experiments with 59 rods, it was observed that the water separated from the oil during the burn. While draining the burner (from the bottom), water was observed to flow out first followed by the emulsion.

Example 4

60% Salt Water-oil Emulsion

The emulsion was prepared with 35 ppt (parts per thousand) saline water. It is observed that adding salt increases stability of the emulsion significantly compared to fresh water. As a first attempt, a flame torch was used to ignite the 60% salt-water emulsion. The emulsion could not be ignited with a torch, so a 0.2 cm (0.08") octane layer was added as a starter fuel to the surface of the emulsion. The objective was to ignite the emulsion and achieve a self-sustaining stead state burn. Although the baseline case with starter achieved a self-sustaining steady burn for 10 min, the flame was very weak and MLR was low. The same amount of starter fuel was used for the "with rods" cases. Starter was used to pre-heat the rods and fuel. The MLR of the baseline, "with 37 rods" and "with 59 rods" cases are 95 g/min, 200 g/min and 567 g/min, respectively. The average flame height of the baseline, "with 37 rods" and "with 59 rods" are 90 cm (35"), 150 cm (60") and 280 cm (110"), respectively. For the "with 59 rods" case, the flame height was enhanced about 300% when compared with the baseline case.

Figure 11A:
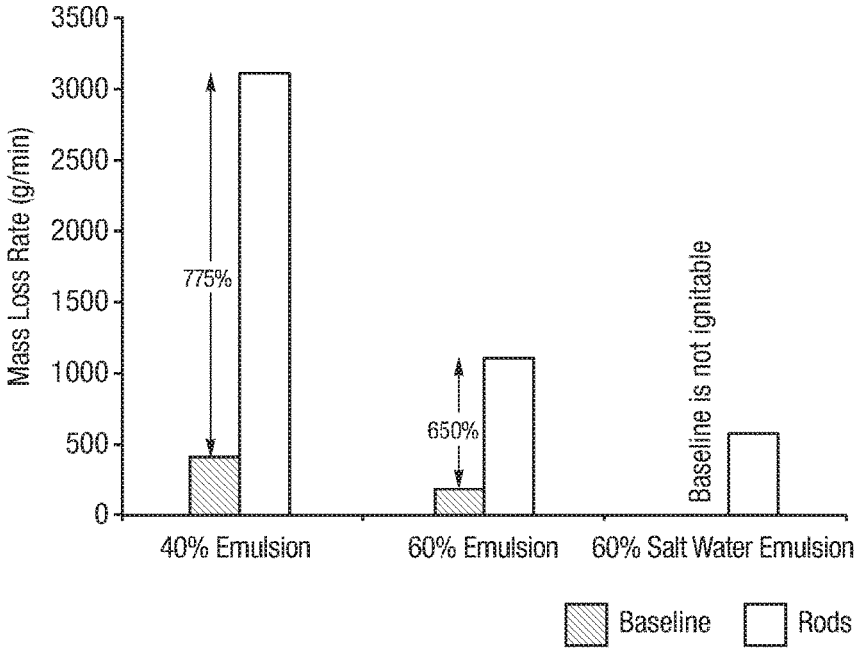
FIG. 11A and FIG. 11B demonstrate a mass loss rate (g/min) of different emulsions.
Figure 11B:
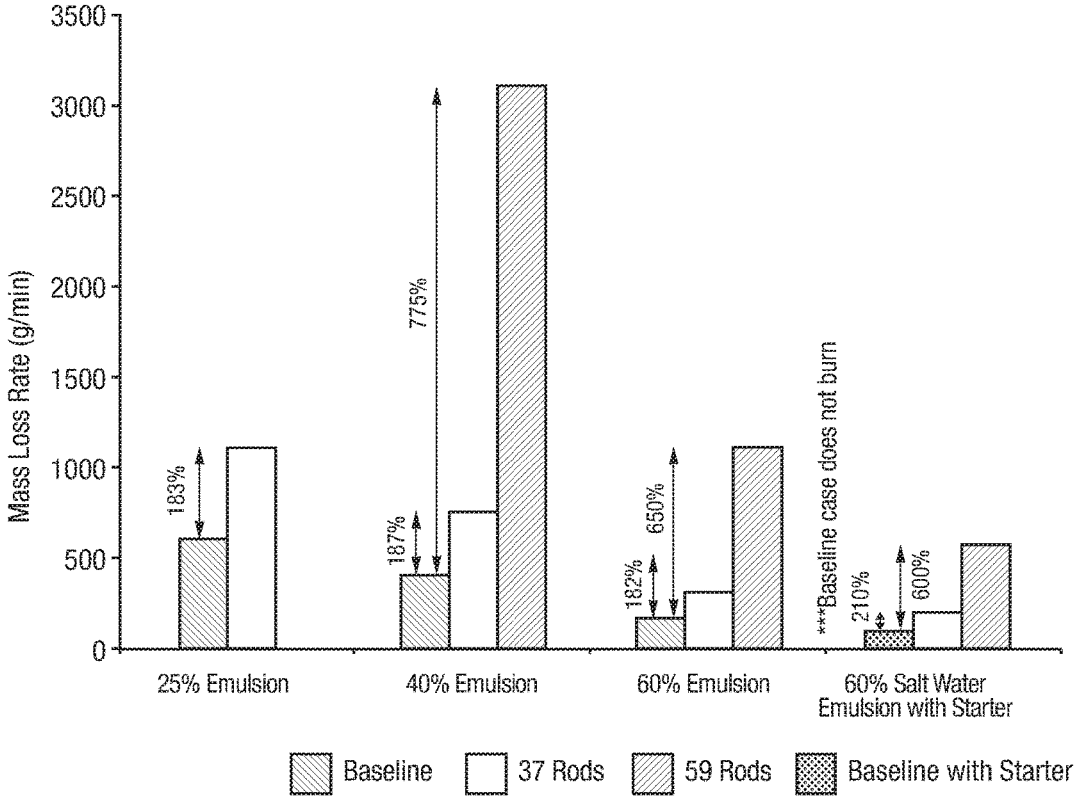

FIGS. 11A and 11B show the mass loss rate (g/min) of different emulsions tested in the large scale prototype burner. In FIG. 11B, the blue bar represents the baseline, while red, and orange bars represent the "with 37 FRs" and "with 59 FRs" cases, respectively. The green bar represents the baseline case with starter for 60% salt-water emulsion. As shown in FIG. 11, significant enhancement of burning rate (up to 775%) can be obtained.

Figure 12A:
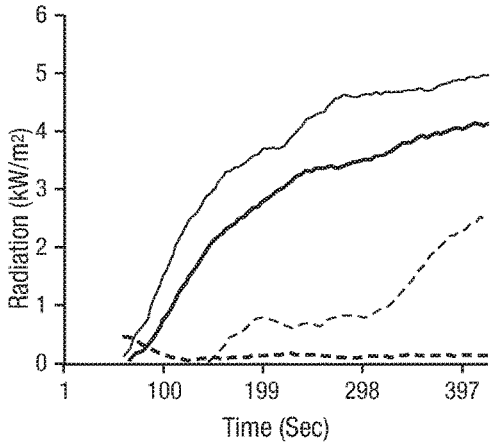
FIG. 12A-12C illustrates an external HFG measurement for a baseline, 37 rods and a 59 rods burn.
Figure 12B:
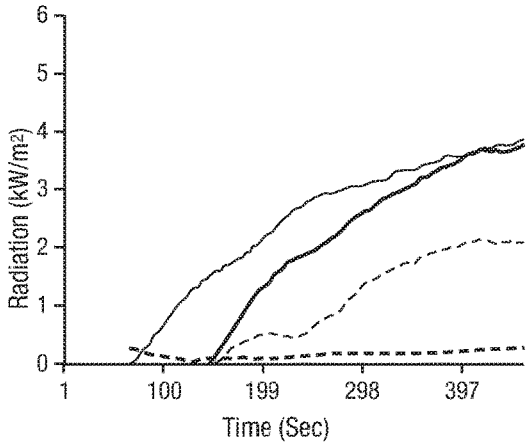
Figure 12C:
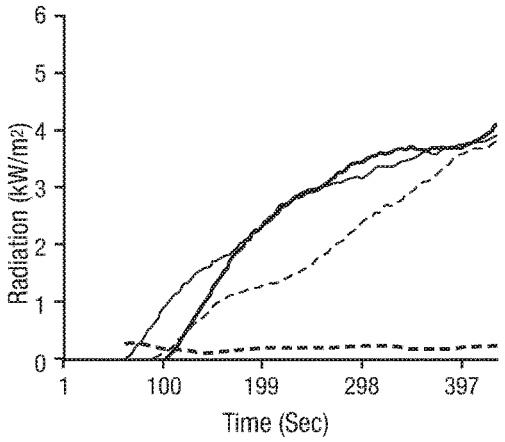
Figure 13A:
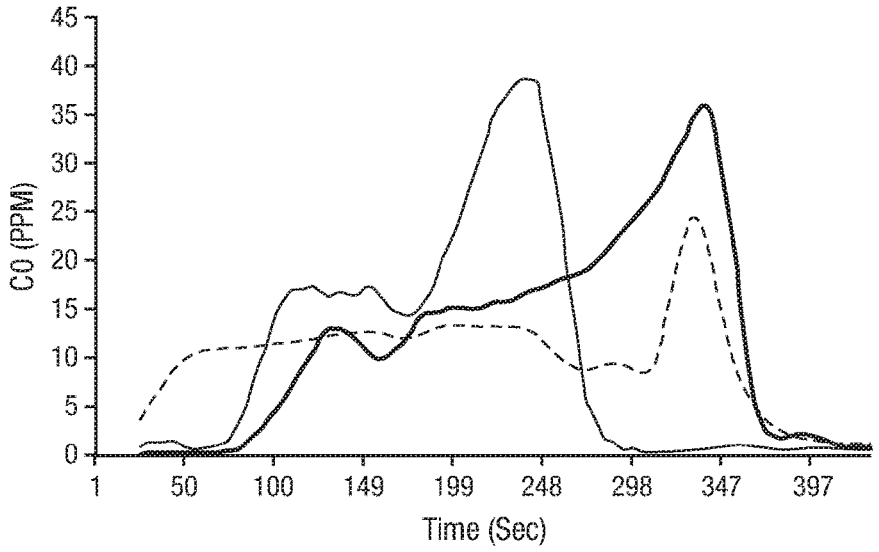
FIG. 13A shows a CO emission of a 60% fresh-water test.
Figure 13B:
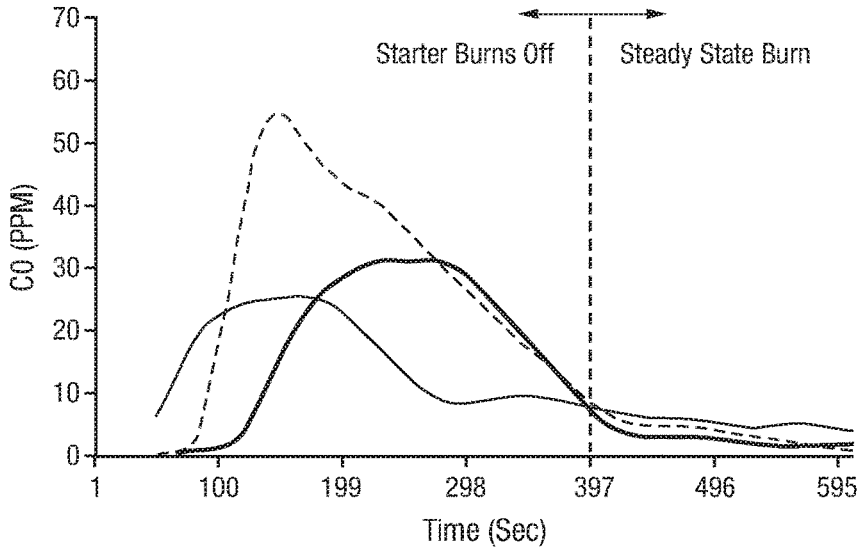
FIG. 13B shows a CO emission of a 60% salt-water emulsion.

FIGS. 12A-12C summarize the external HFG measurements for the baseline, "with 37 rods" and "with 59 rods" cases, respectively. FIGS. 12A-12C presents the data collected from the HFG located at the centerline of the burner. FIGS. 12A-12C show that the rods absorb most of the radiation thereby promoting lower heat loss to the ambient and also aiding in complete combustion of the fuel. The external HFG measuring the radiative heat lost to the ambient shows relatively close values for the baseline and "with 59 rods" cases, although the mass burning rate has enhanced about 650%. A large hood was used to collect the combustion products (CO). The hood has a capacity of 60,000 ft3/min (28 m3/s) and can handle a 3 MW steady state fire. The emission data was collected for 60% fresh-water and 60% salt-water emulsion tests, which represent the worst-case scenarios. FIG. 13A shows the CO emission of the 60% fresh-water tests for baseline, "with 37 rods" and "with 59 rods" cases, respectively. FIG. 13B makes the same comparison for the 60% salt-water emulsion.

As shown in FIG. 13B, the octane layer (starter) burns off in seven minutes (~400 sec) and then steady-state burn was achieved. The results demonstrated that the enhanced burning rate promoted higher flame temperatures thereby aiding in complete combustion of the fuel and reducing quantity of unburned products of combustion (CO). Experimental study showed that burning efficiency, in terms of MLR, reaches to an average value of 180% with 37 rods. As the number of rods is further increased to 59, the burning efficiency increases and reaches an optimum value of 650%.

All patents, patent applications, and published references cited herein are hereby incorporated by reference in their entirety. It should be emphasized that the above-described embodiments of the present disclosure are merely possible examples of implementations, merely set forth for a clear understanding of the principles of the disclosure. Many variations and modifications may be made to the above-described embodiment(s) without departing substantially from the spirit and principles of the disclosure. It can be appreciated that several of the above-disclosed and other features and functions, or alternatives thereof, may be desirably combined into many other different systems or applications. All such modifications and variations are intended to be included herein within the scope of this disclosure, as fall within the scope of the appended claims.

What is claimed is:

1. A system for burning an water-oil emulsion comprising:

an enclosure configured to hold a water-oil emulsion;

one or more conductive rods disposed throughout the enclosure, each rod of the one or more rods having a heater portion to be submerged in the water-oil emulsion and a heat collector portion to project above the water-oil emulsion; and a delivery system for supplying an water-oil emulsion to the enclosure, the delivery system is configured to maintain a pre-determined level of the water-oil emulsion in the enclosure as the water-oil emulsion is burned, wherein the pre-determined level of the water-oil emulsion in the enclosure is maintained so that the heat collector portion is longer than the heater portion.

2. The system of claim 1 wherein the one or more rods have an adjustable height.

3. The system of claim 1 wherein a ratio of a length of the heat collector portion to a length of the heater portion is between 2 and 6.

4. The system of claim 1 wherein a height of the rod is between 25% to 75% of a baseline flame height.

5. The system of claim 1 wherein the one or more rods are distributed among a plurality of zones, with rods in a same zone having same height and rods in different zones having different height.

6. The system of claim 5 wherein the height of the rods increases toward a center of the enclosure.

7. The system of claim 5 wherein the zones are concentric to one another.

8. The system of claim 1 wherein the enclosure further includes one or more inlets.

9. The system of claim 8, wherein each of the one or more inlets includes a cover mechanism to adjustably change the shape of the inlet.

10. A method for burning an water-oil emulsion comprising:

supplying an water-oil emulsion to a holding enclosure to a pre-selected level, the enclosure having one or more heat conductive rods disposed therein, each rod of the one or more rods having a heater portion to be submerged in the water-oil emulsion and a heat collector portion to project above the water-oil emulsion, wherein the pre-selected level of the water-oil emulsion in the enclosure is maintained so that the heat collector portion is longer than the heater portion; and igniting and burning the water-oil emulsion from the enclosure while maintaining the pre-selected level of the water-oil emulsion in the enclosure.

11. The method of claim 10 wherein a ratio of a length of the heat collector portion to a length of the heater portion is between 2 and 6.

12. The method of claim 10 wherein a height of the rod is between 25% to 75% of a baseline flame height.

13. The method of claim 10 wherein the one or more rods are distributed among a plurality of zones, with rods in a same zone having same height and rods in different zones having different height.

14. The method of claim 13 wherein the height of the rods increases toward a center of the enclosure.

15. The method of claim 10 wherein the enclosure further includes one or more inlets.

16. The method of claim 15, wherein each of the one or more inlets includes a cover mechanism to adjustably change the shape of the inlet.

17. The method of claim 10 wherein a water content of the water-oil emulsion is between about 20% and about 60%.

18. The method of claim 10 further comprising preheating the one or more rods before igniting the water-oil emulsion.

19. A system for burning an water-oil emulsion comprising:

an enclosure configured to hold a water-oil emulsion;

one or more conductive rods disposed throughout the enclosure, each rod of the one or more rods having a heater portion to be submerged in the water-oil emulsion and a heat collector portion to project above the water-oil emulsion, wherein the one or more rods have an adjustable height so the heat collector portion is longer than the heater portion; and a delivery system for supplying an water-oil emulsion to the enclosure, the delivery system is configured to maintain a constant level of the water-oil emulsion in the enclosure as the water-oil emulsion is burned.

20. A method for burning an water-oil emulsion comprising:

supplying an water-oil emulsion to a holding enclosure to a pre-selected level, the enclosure having one or more heat conductive rods disposed therein, each rod of the one or more rods having a heater portion to be submerged in the water-oil emulsion and a heat collector portion to project above the water-oil emulsion, wherein the one or more rods have an adjustable height so the heat collector portion is longer than the heater portion; and igniting and burning the water-oil emulsion from the enclosure while maintaining the pre-selected level of the water-oil emulsion in the enclosure.

* * * * *